United States Patent [19]

Jensen et al.

[11] Patent Number: 4,704,961

[45] Date of Patent: Nov. 10, 1987

[54] SCREEN PRINTING ASSEMBLY

[75] Inventors: Roger A. Jensen, 1922 Main, Kansas City, Mo. 64108; John M. Wolfe, Kansas City, Mo.

[73] Assignee: Roger A. Jensen, Kansas City, Mo.

[21] Appl. No.: 723,930

[22] Filed: Apr. 16, 1987 (Under 37 CFR 1.47)

Related U.S. Application Data

[63] Continuation-in-part of Ser. No. 629,571, Jul. 11, 1984, Pat. No. 4,545,300.

[51] Int. Cl.[4] ..... B41F 15/00

[52] U.S. Cl. ..... 101/114; 101/129; 118/406

[58] Field of Search ..... 101/129, 114, 123, 124, 101/126, 211; 118/50, 404, 406, 429

[56] References Cited

U.S. PATENT DOCUMENTS

| | | | |
|---|---|---|---|
| 1,322,667 | 11/1919 | Zemke | 101/114 |
| 1,641,143 | 9/1927 | Allen | 101/114 |
| 1,805,144 | 5/1931 | Jones | 101/211 |
| 1,894,530 | 1/1933 | Bernardo | 101/114 |
| 2,152,274 | 3/1939 | Papazian | 101/114 |
| 2,547,554 | 4/1951 | Beckelman | 101/114 |
| 2,972,303 | 2/1961 | Marchi | 101/426 |
| 2,975,705 | 3/1961 | Gilman | 101/123 |
| 3,081,698 | 3/1963 | Childress et al. | 101/129 |
| 3,137,230 | 6/1964 | Ichinose | 101/114 |
| 3,199,449 | 8/1965 | Jaffa et al. | 101/129 |
| 3,252,411 | 5/1966 | Black | 101/129 |
| 3,282,207 | 11/1966 | Plymale | 101/129 |
| 3,374,731 | 3/1968 | Thorne | 101/124 |
| 3,742,902 | 7/1973 | Heston, Jr. | 101/129 |
| 3,896,722 | 7/1975 | Farrow | 101/114 |
| 3,955,501 | 5/1976 | Bubley et al. | 101/123 |
| 3,980,017 | 9/1976 | Black | 101/129 |
| 4,023,486 | 5/1977 | Linthicum | 101/120 |
| 4,148,604 | 4/1979 | Bachtiger | 101/114 |
| 4,268,545 | 5/1981 | Hodulin | 427/282 |
| 4,545,300 | 10/1985 | Jensen | 101/123 |

FOREIGN PATENT DOCUMENTS

| | | | |
|---|---|---|---|
| 1175156 | 9/1956 | France | 101/114 |
| 572979 | 9/1956 | Italy | 101/114 |
| 591691 | 4/1959 | Italy | 101/114 |
| 362891 | 6/1930 | United Kingdom | 101/114 |

*Primary Examiner*—E. H. Eickholt

*Attorney, Agent, or Firm*—Fitch, Even, Tabin & Flannery

[57] ABSTRACT

A screen printing assembly attachable to a screen frame supporting a screen having a pattern. A support frame, which comprises a flat aluminum extrusion, is positionable adjacent and attachable to the screen frame. A squeegee assembly is movable relative to the support frame and positionable generally on the screen to press ink through the screen. A sealed chamber is connected to the bottom of the support frame and positionable generally adjacent the screen. The squeegee assembly presses the ink through the screen within this sealed chamber. The sealed chamber safety contains the printing ink solvents which are deposited in it. A flexible plastic sheet forms the upper surface of the sealed chamber. This sheet, which can have ultra-violet properties, rolls at its opposite ends about rod assemblies. The sheet is attached to the squeegee assembly and moves with it between these rod assemblies. Tension springs mounted in the rod assemblies keep the sheet taut. The rod assemblies are mounted at their ends in bearing members, which are mounted to and depend from the support frame. The bearing member are mounted to the support frame so that they are inside of the screen frame or, alternatively, at the outside ends. The support frame has length adjustable sides so that it can fit all conventional presses.

17 Claims, 13 Drawing Figures

SCREEN PRINTING ASSEMBLY

The present application is a continuation-in-part of co-pending application Ser. No. 629,571, filed July 11, 1984, entitled "Screen Printing Apparatus and Process", now U.S. Pat. No. 4,545,300, the contents of which are hereby incorporated by reference in their entirety.

BACKGROUND OF THE INVENTION

This invention relates to printing apparatuses and processes, and more particularly to automated or manual printing by silk screening. It further relates to all types of ink printing presses using squeegee mechanisms for pressing the ink through the screen.

Numerous printing apparatuses are known, including those shown in U.S. Pat. Nos. 2,975,705 and 3,955,501, the contents of which are hereby incorporated by reference in their entirety. Basically they show a support frame positionable on top of a screen frame. Means attached to the support frame deposit ink on the screen and then force it through the screen pattern onto an underlying substrate. Solvents can be sprayed on the ink to keep it at its proper consistency and thus to keep it from drying out. However, these harmful solvents and other chemicals are thereby released into the environment endangering the health of the operator and others standing nearby. Another problem associated with prior screen printing apparatus is that the ink rapidly dries on the screen and the whole process must be periodically shut down so that the screen can be cleaned.

On occasion in the past, large, cumbersome hoods which fit over the entire press have been custom designed and used. These hoods have doors through them to provide access to the squeegee/floor bar pressure adjustments, hinge clamps, and other controls. The press would have to be shut down at a certain position, however, to allow adjustment of the controls through that door. Additionally, this design created a safety hazard since solvent fumes were contained within the hood, and these fumes could be ignited by the contact of the metal press parts or from the electrical connections of the press.

The screen printing apparatus disclosed in U.S. Pat. No. 4,545,300 has certain disadvantages which the present invention remedies. For example, that apparatus will not work on all types of presses. That apparatus also presents an undesirably deep framework which does not allow the apparatus to fit into the master frame which sits around the press. It further was a time-consuming process to attach the novel chamber arrangement of that apparatus to the silk screen frame and to properly align the bearings for each use.

OBJECTS OF THE INVENTION

Accordingly, it is the principal object of the present invention to provide an improved apparatus and process for screen printing.

Another object of the present invention is to provide an improved screen printing apparatus that works on all types of presses, manual or automated, and with all types of inks.

A further object of the present invention is to provide a novel screen printing apparatus that reduces the contamination of the atmosphere by harmful solvents and chemicals.

A still further object of the present invention is to provide an improved screen printing apparatus that exposes the operator thereof to considerably smaller amounts of harmful solvents.

Another object is to provide an improved screen printing apparatus that keeps the ink at its proper consistency for longer periods of time and also prevents it from prematurely drying out.

A further object is to provide a novel screen printing apparatus that reduces the frequency of the down time needed to clean the dried ink from the screen thereby increasing the productivity of the screen printing process.

A still further object is to provide an improved screen printing apparatus that is able to print finer details and half tones with a solvent base ink system than previously was possible.

Another object is to provide a design for a novel screen printing apparatus whose controls are readily accessible.

A further object is to provide a novel screen printing apparatus which easily attaches to any conventional silk screen frame with few mounting adjustments.

A still further object is to provide a novel construction and configuration of the screen printing squeegee/flood bar unit.

Another object is to provide a novel silk screen self-contained framework which easily slips into any conventional silk screen frame of any length.

A futher object is to provide a novel silk screen chamber design which when seated within the silk screen frame does not significantly increase the height of the apparatus.

A still further object is to provide a novel means for maintaining the fast drying ink of the modern larger and faster presses at their proper viscosity for longer periods of time.

Another object is to provide a novel screen printing apparatus that can be used with ultra-violet ink systems.

Other objects and advantages of the present invention will become more apparent to those persons having ordinary skill in the art to which the present invention pertains from the foregoing description taken in conjunction with the accompanying drawings.

DETAILED DESCRIPTION OF THE INVENTION

Figure 1:
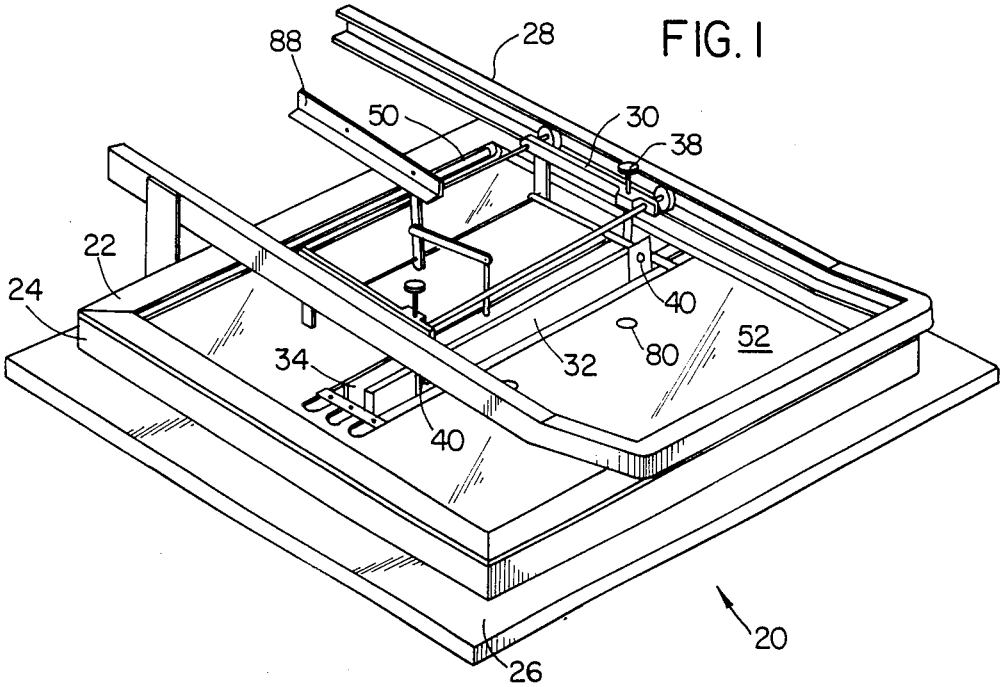
FIG. 1 is a perspective view of an automated screen printing apparatus embodying the present invention.

Referring to FIG. 1, an automated screen printing apparatus embodying the present invention is illustrated generally at 20. It comprises a support frame 22 to which generally all of the components are attached, a silk screen frame 24 positioned beneath support frame 22 and hinged at the rear and supporting a silk screen having the desired pattern thereon, and a press bed or substrate 26 which forms a level surface on which the stock to be imprinted is placed and on which screen frame 24 rests. Press bed 26 supports a generally horizontal, U-shaped carriage track 28 held above and extending the length of support frame 22. A printing head carriage 30 holding the squeegee 32 and flood bar 34 moves in carriage track 28 along the length of support frame 22.

Figure 3:
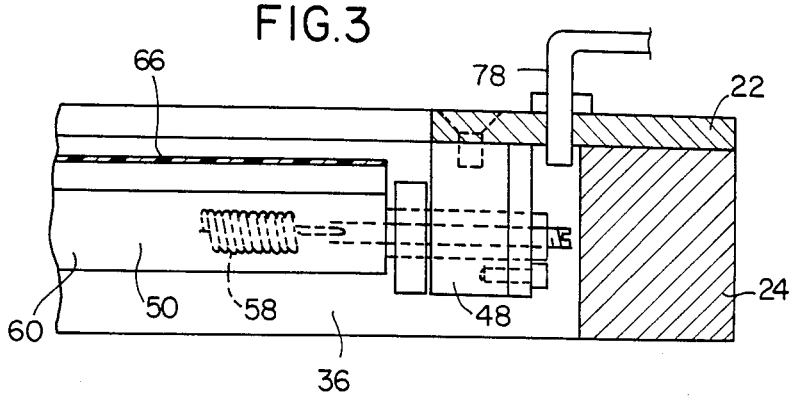
FIG. 3 is an enlarged partial cross-sectional view taken along line 3—3 of FIG. 2.
Figure 4:
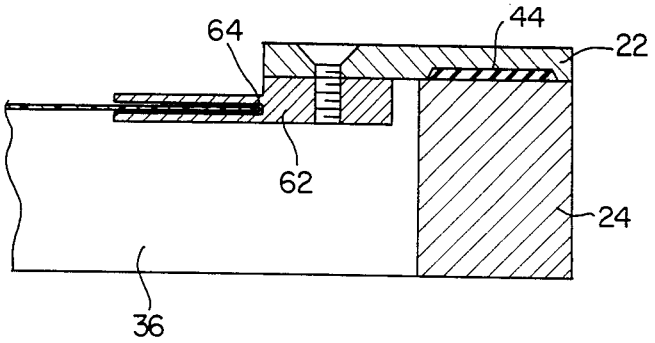
FIG. 4 is an enlarged partial cross-sectional view taken along line 4—4 of FIG. 2.

Squeegee 32 and flood bar 34 are positioned at their lower ends in a sealed chamber as generally shown at 36 in FIGS. 3 and 4. They first coat the silk screen with a coating of ink and then force the ink through the screen onto the substrate. Sealed chamber 36, which is seated below printing head carriage 30, defines a controlled environment for depositing the ink and for spraying the solvents, thereby providing a safer and more productive screen printing apparatus than previously possible. It is further noted that, with this unique sealed chamber design, the squeegee/flood bar pressure controls 38, 40 as well as the hinge clamps are positioned outside of sealed chamber 36 and thus are easily and readily accessible for adjustment.

All components of the apparatus are attached to support frame 22. It consists of a flat aluminum stock, cut and welded and having a short profile in thickness or depth of only about one-quarter to one-half inch, and all parts of the apparatus are attached to the bottom of this flat aluminum extrusion. Support frame 22 rests on the side members 42 of silk screen frame 24 and is held thereto by clamps. A closed cell Neoprene rubber gasket 44 is adhered to the bottom of the support frame 22 and is positionable against the upper surface of side member 42 of the silk screen frame defining a seal between silk screen frame 24 and support frame 22 when they are held or clamped together.

Bearings 48 are attached to and extend down from support frame 22 inside of silk screen frame 24, as shown in the embodiment of FIG. 3. Two pairs of such bearings 48 are provided at opposite ends of support frame 22. Each pair of bearings supports at its ends, and provides generally friction free movement of, a shaft or rod assembly 50 at either end of the frame. A plastic sheet or curtain 52 extends between and rolls at its opposite ends around shaft or rod assemblies 50. Sheet 52 has front and back sheet sections 54, 56 and squeegee and flood bar assembly in connected between them and when the assembly is moved from one support frame end to the other, plastic sheet 52 will either roll up or roll off of the respective shaft or rod assembly 50 as required. To keep sheet 52 in a constant taut condition, tension springs 58 are positioned inside of the rods 60 of rod assemblies 50, as best shown in FIG. 3. Tension spring 58 is attached to rod 60 at one end and at the other is attached to bearing 48 with a spring-to-bearing connector. It is further within the scope of the present invention for plastic sheet 52 to have ultra-violet filtering properties so it can be used with ultra-violet ink systems thereby keeping the ink from precuring in the screen.

Figure 8:
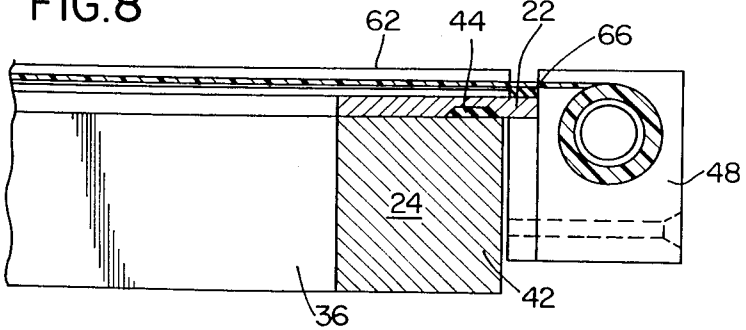
FIG. 8 is a enlarged fragmentary cross-sectional view taken along line 8—8 of FIG. 7.

The edges of plastic sheet 52 are fitted in and travel in side seals 62 attached to support frame 22. Referring to FIGS. 4 and 8, it is seen that side seals 62 are formed from an extruded plastic configured to have a thin space 64 passing through the center thereof. Plastic sheet 52 travels in thin space 64 and a seal is thereby formed therebetween. Front and back seals 66, as best shown in FIGS. 3 and 8, are formed from extruded plastic and positioned so as to apply pressure down against plastic sheet 52 creating a seal therebetween.

Figure 5:
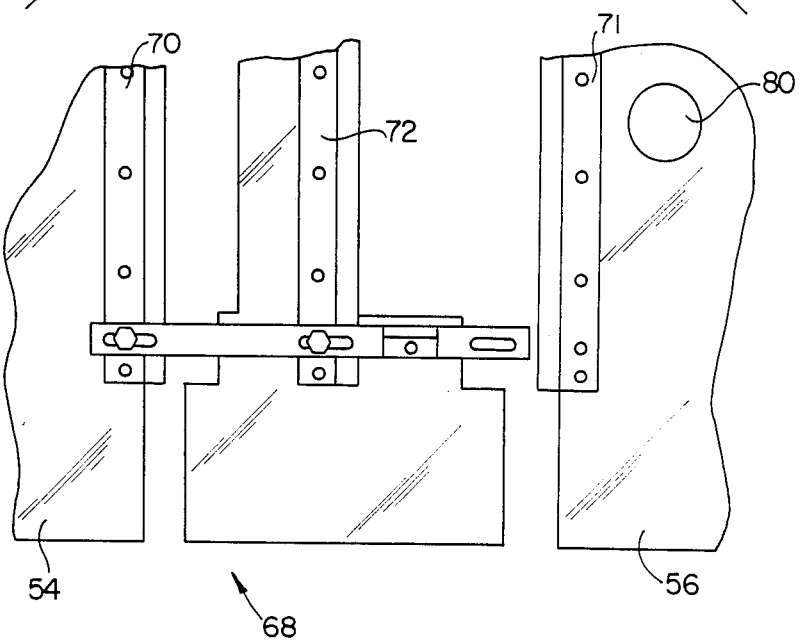
FIG. 5 is an enlarged fragmentary view of the squeegee/floor bar unit of FIG. 2.
Figure 6:
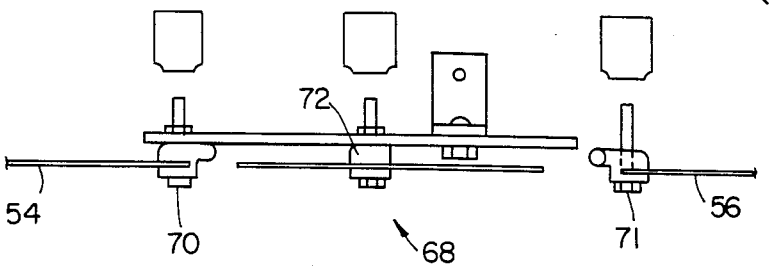
FIG. 6 is a side elevational view of the squeegee/flood bar unit of FIG. 5.

The squeegee and/or flood bar enclosure units, illustrated generally at 68 in FIGS. 5 and 6, have their individual parts made from extruded aluminum and plastic. When this unit is manufactured it is actually in three parts. One part 70 is attached to front plastic sheet 54; one part 71 is attached to back plastic sheet 56; and the third part 72 fits between the squeegee 32 and flood bar 34 enclosing the squeegee-flood bar are. The plastic sheets are pulled together and attached to each other via the squeegee enclosure unit shown generally at 74.

Figure 13:
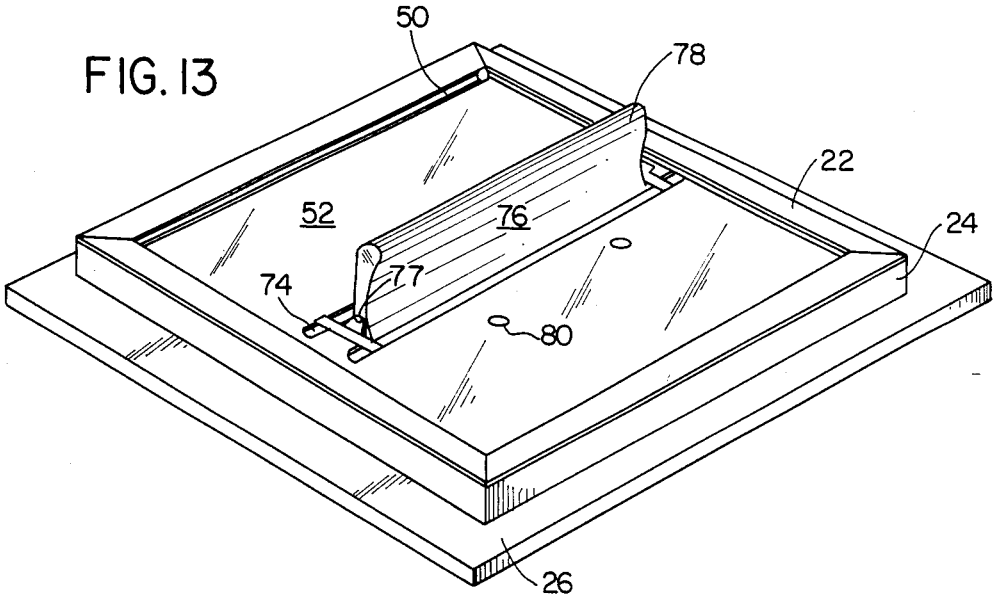
FIG. 13 is a perspective view of a manual screen printing apparatus embodying the present invention.

It is noted though that for on-hand or manual printing operations, flood bar 34 is not used. Rather, as best shown in FIG. 13, squeegee 32 is used to deposit the ink on the silk screen. In that instance, the unit consists of two parts, one connecting to the front and one connecting to the back of squeegee 32. An elongated handle 76 is secured to the squeegee enclosure unit using suitable end brackets and screws 77. As shown, handle 76 is configured to be easily grasped on its top edge 78 by the operator and manually moved from one end of support frame 22 to the other for printing after the squeegee has been positioned within the squeegee enclosure 74 and ink poured through inking caps 80.

Figure 2:
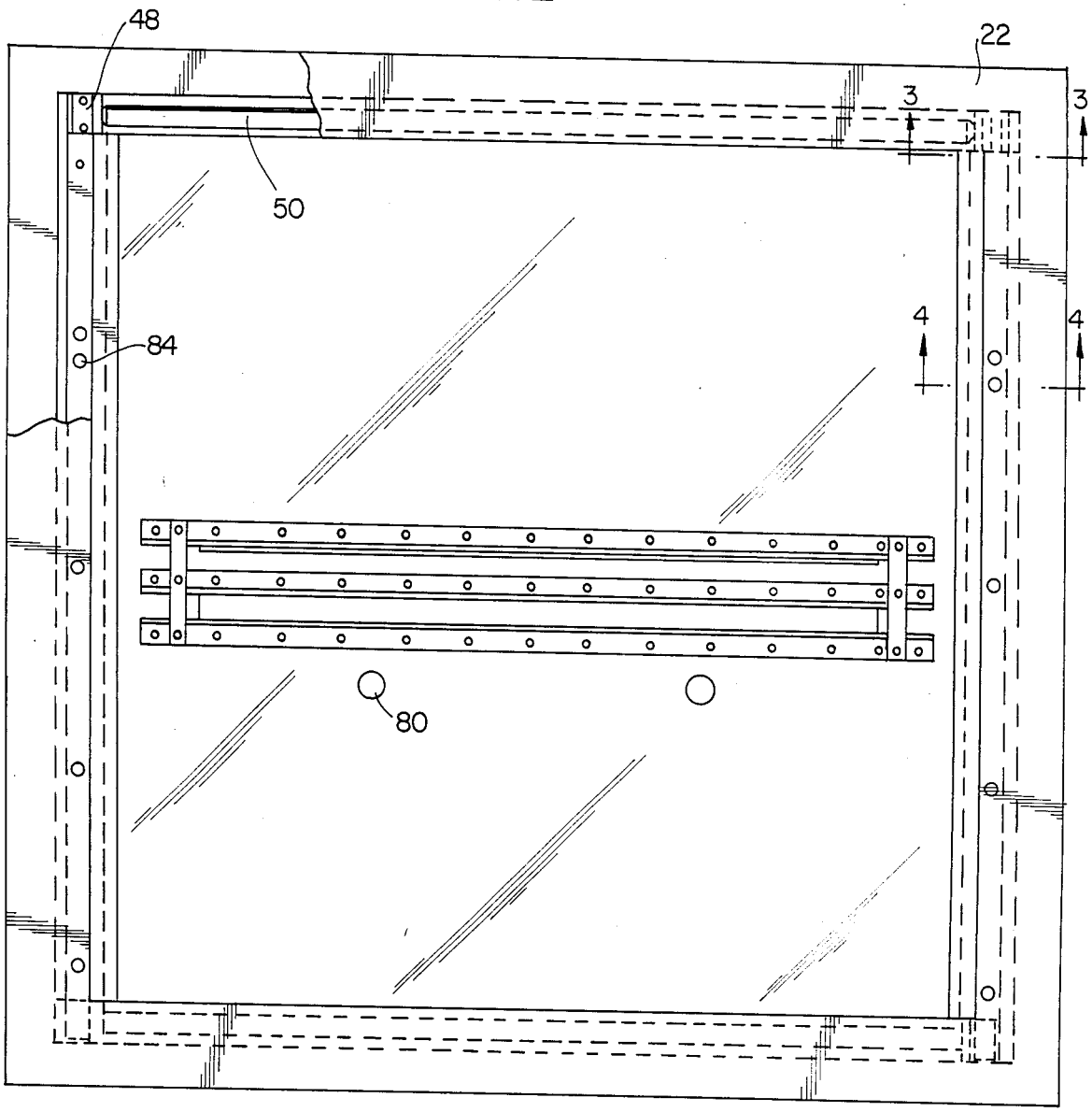
FIG. 2 is a top plan view of the apparatus of FIG. 1 without the track and carriage system and having a portion thereof broken away for the sake of clarity.

Sealed chamber 36 is formed at least in part by plastic sheet 52, front and back seals 66, and side seals 62. Inert gas, such as $CO_2$ or nitrogen, can be pumped into chamber 36 through a line 82, best shown in FIG. 2, displacing the oxygen in chamber 36 and the inert gases are maintained in the chamber at generally atmospheric pressure. Without oxygen the ink in chamber 36 will not prematurely dry. Further, suitable solvents can be sprayed into the chamber through lines entering at the connector shown at 84 in FIG. 2. The solvent is contained within chamber 36 and thus does not exhaust onto the atmosphere thereby endangering the health of the operator or others in the vicinity of apparatus 20. The inert gas also minimizes the danger of the contained solvents exploding. The ink is better kept at its proper consistency in this sealed inert gas chamber 36 and it is also possible in the chamber to print finer details and half tones than were previously possible with other solvent ink systems. Since the ink does not dry as rapidly, the down time needed to clean the dried ink is reduced and printing productivity is thereby increased. As shown in FIGS. 1 and 2, inking caps 80 extending through the surface of plastic sheet 52 provide access to the inside of chamber 36 for the deposit of the ink into the chamber.

Figure 7:
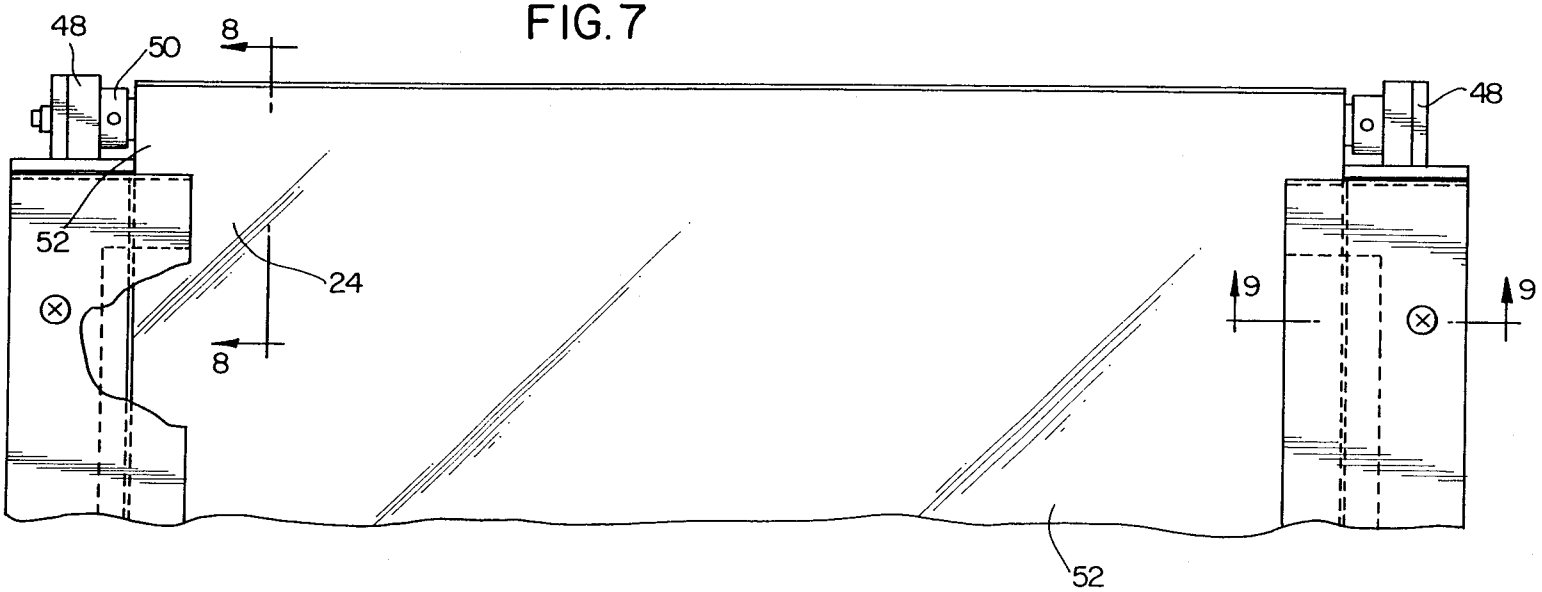
FIG. 7 is a fragmentary top plan view of a second embodiment of the present invention.
Figure 9:
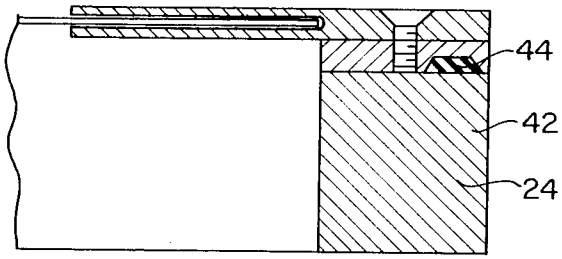
FIG. 9 is an enlarged fragmentary cross-sectional view taken along line 9—9 of FIG. 7.

By attaching bearings 48 to support frame 22, instead of attaching the bearings and rod assemblies directly to the silk screen frame via extrusion for each use as is shown in Application Ser. No. 629,571, quicker attachment of chamber 36 to silk screen frame 24 is possible. Additionally, the user does not have to worry about the proper alignment of the bearings for each use of the chamber. The embodiment of FIGS. 2 and 3 shows a design according to the present invention wherein the bearings depend from the bottom of support frame and are positioned inside of the silk screen frame between its side members 42. An alternative embodiment illustrated in FIGS. 6–8 shows the bearings 48 and the rod assemblies 50 fitted outside of frame 22.

Figure 10:
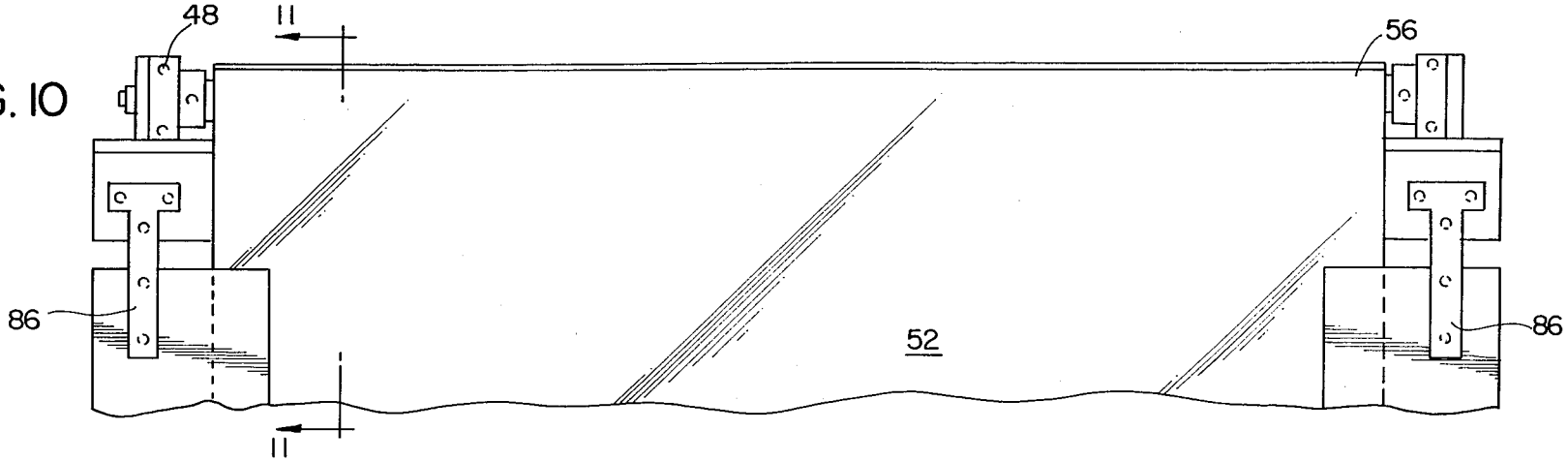
FIG. 10 is a fragmentary top plan view of a variation of the embodiment of FIG. 6.
Figure 11:
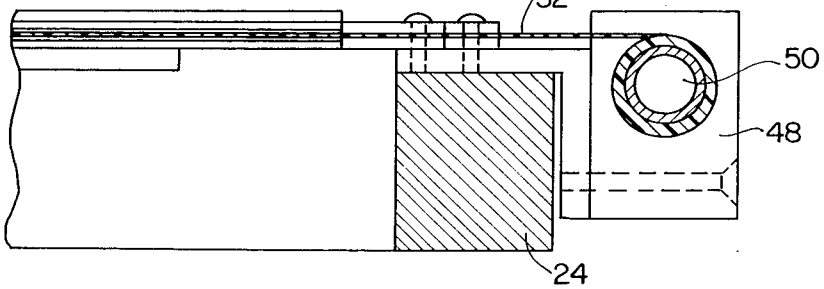
FIG. 11 is an enlarged fragmentary cross-sectional view taken along line 11—11 of FIG. 10.
Figure 12:
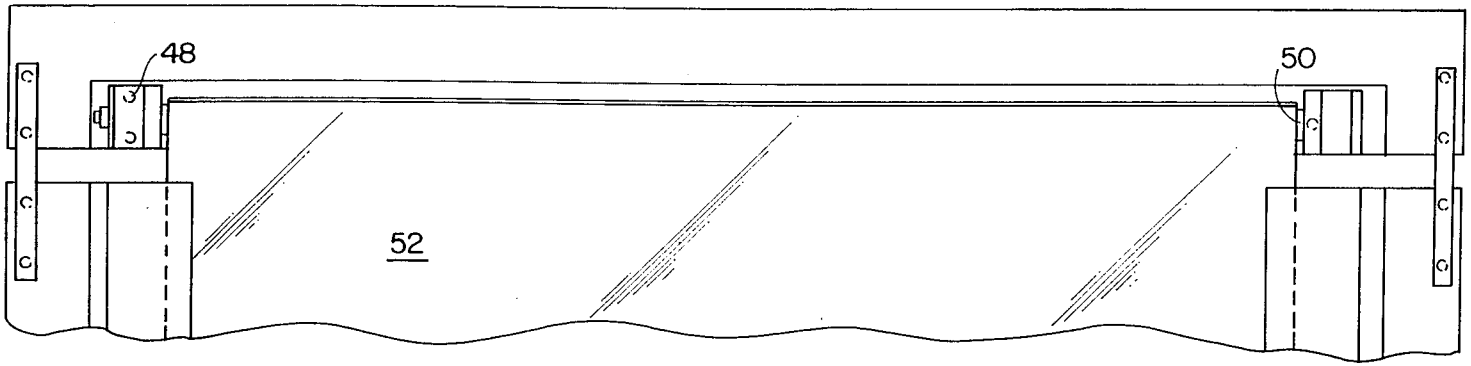
FIG. 12 is an enlarged fragmentary top plan view of a modification of the design of FIG. 2.

To accommodate silk screen frames of different lengths, a novel adjustable side guide device 86 is provided. Referring to FIG. 10, the adjustable side guide 86 is shown mounted on a frame design wherein the bearing and rod assemblies are positioned outside of the silk screen frame. For this device, the individual side guides 86 are cut to different lengths. It can also be used on the other embodiment wherein bearings 48 and rod assemblies 50 are mounted inside of the frame, as best shown in FIG. 11. One frame unit can then be adjusted to fit a number of silk screen frame lengths.

In a conventional manner then, printing head carriage 30 moves to the front of the press by a typical motorized means (for manually), flood bar 34 lays a deposit of ink on the silk screen stencil. Then when carriage 30 moves by its carriage drive to the back of frame 22, flood bar 34 is lifted up by flood bar lift 88 shown in FIG. 1 and squeegee 32 comes in contact with the silk screen thereby forcing the ink through the silk screen pattern onto the substrate as carriage 30 moves on its track 28. Plastic sheet 32 moves together with the carriage in its side seals 66 and is continuously kept taut and sealed to the frame by the sealing means of sealed chamber 36.

The present unit can also be used with an automatic ink feed pump, such as the "Press-Mate Ink Feeder" sold by Advance Process Company. This feeder unit will feed any type of ink through its feed tubes to the press. Tubing (not shown) can be provided running from the pressure chamber of that unit to the ink caps of the present invention to continuously supply ink to the press.

The press illustrated in FIG. 1 is a semiautomatic clam shell type press that is hinged in the back and lifts the screen frame in the front. However, this invention will work on all types of silk screen presses both manual or automatic, and can be used with all types of inks. In particular, the embodiments herein disclosed will work on the M&M presses manufactured by the Medalist M&M Research out of Butler, WI, as well as the presses manufactured by the Advance American Printing Presses out of Chicago, IL. It further will work on cylinder type presses or so-called "four-post" type printing presses. Additionally, this design can be manufactured directly on any press since the screen frame can be slid into the master frame and clamped down on the sides or on the front and back.

From the foregoing detailed description it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. A screen printing assembly attachable to a screen frame supporting a screen having a pattern comprising:

a support frame positionable adjacent and attachable to the screen frame, a squeegee assembly movable relative to said support frame and positionable generally on the screen to press ink through the screen, a chamber means connected to said support frame and positionable generally adjacent the screen for defining a sealed chamber in which said squeegee assembly presses the ink through the screen, said sealed chamber including a chamber upper surface through which said squeegee assembly passes into said sealed chamber, a depositing means operatively connected to said chamber means for depositing solvents into said sealed chamber, and said sealed chamber being adapted to contain within the solvents deposited by said depositing means.

2. The assembly of claim 1 including, a moving means positioned outside of said sealed chamber and operatively connected to said squeegee assembly for moving said squeegee assembly relative to said support frame.

3. The assembly of claim 2 including, said moving means including a handle connected to said squeegee assembly for manually moving said squeegee assembly.

4. The assembly of claim 2 including, said moving means including a motorized drive carriage system connected to said squeegee assembly.

5. The assembly of claim 1 including, said squeegee assembly including a flood bar for depositing ink on the screen.

6. The assembly of claim 1 including, said support frame including a frame length adjustment means.

7. The assembly of claim 1 including, said chamber upper surface comprising a flexible sheet having ultra-violet filtering properties.

8. The assembly of claim 1 including, said upper chamber surface comprising a flexible sheet attached to and movable with said squeegee assembly, and said chamber means including a sealing means for sealing said flexible sheet to said support frame as said flexible sheet moves relative to said support frame.

9. The assembly of claim 8 including, said chamber means including a pair of spaced roller rod assemblies supported from said support frame and about which opposite ends of said flexible sheet roll.

10. The assembly of claim 9 including, said chamber means including a bearing means depending from said support frame for supporting said rod assemblies.

11. The assembly of claim 10 including, said bearing means being positioned inside of the screen frame.

12. The assembly of claim 10 including, said bearing means being positioned outside of the screen frame.

13. The assembly of claim 10 including, said rod assembly including a rod and a tension spring positioned inside said rod, and said tension spring being attached at one end to said rod and at its other end to said bearing means.

14. The assembly of claim 13 including, said tension spring being adapted to keep said flexible sheet taut on said rod assembly.

15. The assembly of claim 1 including, an expelling means operatively connected to said chamber means for expelling the oxygen from said sealed chamber.

16. The assembly of claim 1 including, said chamber means including a sealing means for sealing said chamber upper surface relative to said squeegee assembly and said support frame as said squeegee assembly moves relative to said support frame.

17. The assembly of claim 1 including, said squeegee assembly including at least one squeegee assembly control positioned outside said sealed chamber.

* * * * *